United States Patent [19]

Shore

[11] 4,313,484

[45] Feb. 2, 1982

[54] SELF-INFLATING SOLAR CURTAIN

[76] Inventor: Ronald H. Shore, P.O. Box 238, Snowmass, Colo. 81654

[21] Appl. No.: 833,581

[22] Filed: Sep. 15, 1977

[51] Int. Cl.[2] ..... E06B 9/17

[52] U.S. Cl. ..... 160/121 R; 160/271

[58] Field of Search ..... 160/25, 41, 120, 121, 160/122, 237, 238, 271, 6, 11, 84 R, 84 M; 49/471

[56] References Cited

U.S. PATENT DOCUMENTS

| | | | |
|---|---|---|---|
| 2,328,257 | 8/1943 | Butts | 160/121 R |
| 3,110,343 | 11/1963 | Guffan | 160/11 |
| 3,236,290 | 2/1966 | Lueder | 160/241 |
| 3,860,055 | 1/1975 | Wild | 160/6 |
| 3,918,512 | 11/1975 | Kuneman | 49/477 |
| 4,039,019 | 8/1977 | Hopper | 160/121 R |
| 4,095,639 | 6/1979 | Ryan | 160/84 R |

FOREIGN PATENT DOCUMENTS

| | | | |
|---|---|---|---|
| 756270 | 9/1956 | United Kingdom | 160/84 R |

*Primary Examiner*—Peter M. Caun

*Attorney, Agent, or Firm*—Laff, Whitesel & Rockman

[57] ABSTRACT

This invention relates to a self-inflating solar curtain and to the mechanism for automatically raising and lowering same between its operative and inoperative positions in response to the direction of heat flow into and out of a confined space within which the temperature is to be controlled. The curtain comprises at least one double walled air-entraining envelope folded along its lower edge to provide a cradle supporting a rigid combination spreader, weight and guide member effective to maintain a permanent air pocket at the base thereof. Vents are provided in the envelope for taking air into the pocket as well expelling air therefrom as the curtain is raised into its inoperative position through the gap left between a pair of pinch rollers mounted overhead. The sides of the envelope are left open but confined and sealed within the opposed channels of a pair of tracks mounted alongside thereof. The curtain is wound and stowed on a storage drum above the pinch rollers that is driven by a reversible motor preferably automatically controlled by a sensor responsive to temperature differentials on opposite sides of the curtain. A heating/cooling switch functions to reverse the action of the curtain for a given response of the sensor.

25 Claims, 6 Drawing Figures

SELF-INFLATING SOLAR CURTAIN

In a room, building or other walled enclosure having windows or other glazed areas designed for passive solar collection, the solar insolation entering the enclosure will be absorbed and this energy will be stored by raising the temperature of the enclosed mass. The efficiency with which this stored energy can be retained is a function of the overall insulation of the structure.

Permanently installed insulation consisting of commercially available insulating materials placed in the walls, under the floors and over the ceiling can ordinarily be depended upon to reduce losses through these areas to acceptable levels. Glazed areas on the other hand, even those which are doubly or triply glazed, account for abnormally high energy losses and about the only known way of reducing these losses is to cover the glazed area with some kind of movable insulation whenever the energy being received from the incoming insolation is less than that which escapes therethrough.

During summertime operation, these glazed areas need to be kept covered during those periods in which the solar gains exceed the energy losses through these same areas because, otherwise, non-renewable energy sources must be called upon for cooling purposes. Conversely, at night the insulation should be removed to dissipate the unwanted energy by radiating it out into the clear sky of a summer night.

It has now been found in accordance with the teaching of the instant invention that an ideal removable insulation barrier can be made out of a self-inflating curtain consisting of at least two layers of material maintained in permanently spaced relation by a spreader placed therebetween, means at the top for preventing the escape of trapped air therethrough, and a pair of vertically-disposed tracks confining the open side margins of the curtain cooperating therewith and with the overhead means to define an air-entraining envelope. The envelope has openings in the base thereof effective to draw in additional air when the residual air in the permanent pocket along its lower edge heats up and resist to inflate the portion of the envelope thereabove that has collapsed. Two such envelopes, one inside the other plus a single layer disposed within the smaller envelope of the two comprises the preferred embodiment. Also preferred is the construction wherein one side at least of each layer is provided with a reflective coating such as, by way of example, the surface of the outermost layer nearest the glazed area and the surfaces of all other layers facing into the area in which the environment is being controlled.

The mechanism also encompasses an automatic curtain control responsive to temperature differentials existing on opposite sides of the curtain. In the summer mode, the control system becomes automatically operative to lower the curtain when the temperature on the side of the curtain nearest the glazing exceeds that on the opposite (room side) thereof while raising the curtain when the opposite condition exists. In winter mode, the controls system raises the curtain when the sun is out and lowers it at night.

It is, therefore, the principal object of the present invention to provide a novel and improved self-inflating curtain to be placed in front of glazed areas in the wall of an enclosure when the temperature is to be controlled.

A second objective is to provide a temporary heat transfer barrier of the class described which is more efficient as an insulating medium than a fiberglass batt several inches thick.

Another object of the invention forming the subject matter hereof is to provide an inflatable curtain wherein the only demands for non-recoverable energy are those minimal ones necessary to raise and lower same and even these could, if desired, be supplied by storage batteries recharged by solar cells.

Still another objective is the provision of a unique assembly wherein the side margins of the curtain are left open and confined within the opposed channels of transversely-spaced vertically-diposed tracks alongside thereof which cooperate with one another and with seals along the top and bottom edges to define at least one air-entraining envelope.

An additional object is to provide a control mechanism for the inflatable curtain selectively operative to lower the curtain when the summer sun shines thereon while raising it at night yet, in the winter, raising it to take advantage of the suns warmth while lowering it to prevent the escape of the heat thus captured to the cold winter air out-of-doors.

Further objects are to provide a self-inflating curtain that is efficient, lightweight, readily adaptable to various sizes of glazed areas, versatile, convenient, easy to install and operate, and a unit of the type described that is decorative and can be made compatible with almost any room decor.

Other objects will be in part apparent and in part pointed out specifically in connection with the description of the drawings that follows, and in which.

Figure 1:
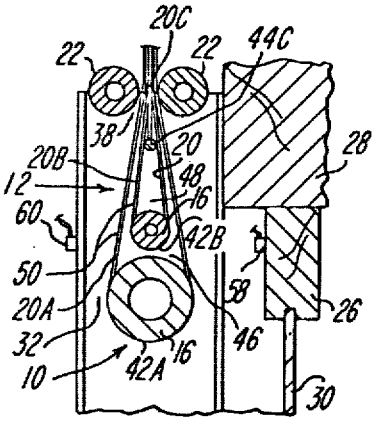
FIG. 1 is a vertical section, portions of which have been broken away to conserve space, showing the self-inflating curtain and associated elements of the assembly which includes same mounted in place within the exterior wall of a confined space containing a window, the curtain having been shown raised into its inoperative position.
Figure 1:
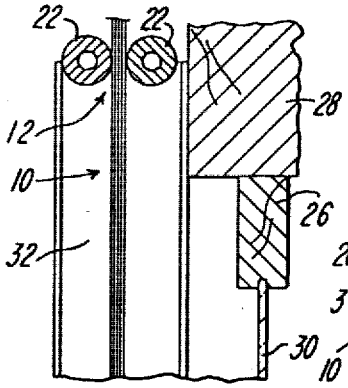
Figure 1:
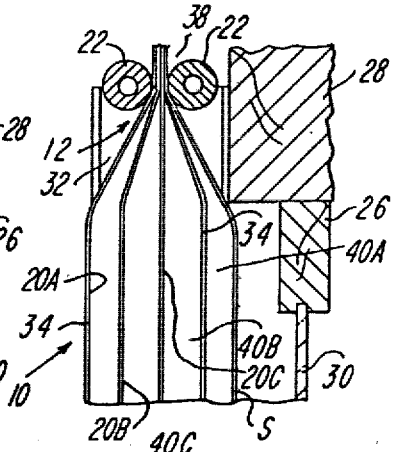
Figure 1:
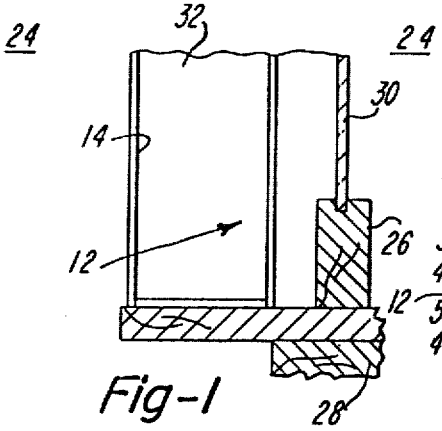

Referring next to the drawings for a detailed description of the present invention and, initially, to FIGS. 1-5, inclusive, for this purpose, reference numeral 10 has been chosen to broadly designate the solar curtain or air bag assembly in its entirety while reference numeral 12 has been selected to similarly connote the curtain alone, said assembly 10 including among other things tracks 14 encasing the side margins of the curtain or air bag, spreaders 16 cradled in the folds 18 at the bottom of each air-entraining envelope 20, and a horizontally-disposed pair of pinch rollers 22. The pinch rollers are supported in a spaced, parallel relationship so that they define between them a horizontal deflation slot. Reference numeral 24 represents a confined air space such as within a room of a home or office, the temperature of which is to be controlled. Numeral 26, on the other hand, represents a window frame or casement in an exterior wall 28, the frame being glazed with glass pane 30.

Figure 5:
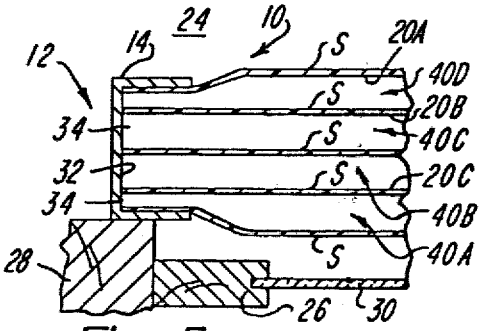
FIG. 5 is a fragmentary horizontal section taken along line 5—5 of FIG. 3 and to the same scale as the latter; and, FIG. 6 is a fragmentary bottom plan view of the control mechanism and curtain driven of FIG. 4, all to the same scale.

Tracks 14 are shown mounted on the wall 28 bordering the window frame 26 and each such track defines an inwardly-opening channel 32 which is most clearly revealed in FIG. 5. The channels 32 of the two tracks are essentially vertical and oppose one another in transversely-spaced parallel relation. These channels cooperate with one another and with the open side margins 34 of each air-entraining envelope 20 confined therein to trap air inside the latter, all of which, once again, is most clearly revealed in FIG. 5.

The curtain itself, 12, comprises at least two, and preferably four or five layers of a relatively thin flexible material capable of being rolled up and stored on an overhead storage roller 36 mounted above the pinch rollers 22 in position to receive the various layers as they pass up through gap 38 between the latter. As the curtain is rolled up upon the roller, it must pass through the deflation slot formed between the pinch rollers 22 in order to squeeze most of the air from the curtain. In the preferred form of the invention, the layers of the curtain are coated with a substance of high reflectivity (S) and low emissivity, many of which are well known in the art and these coatings per se form no part of the instant invention. Functionally, they are most beneficial in preventing energy loss from the direction toward which they are facing, therefore, in instances where they are being used to prevent energy loss from a heated mass (confined air space 24) they should face toward this mass. If the material being used is coated on only one of its two surfaces, the application is one primarily of solar heating, and the curtain is a multilayered one such as has been illustrated, then the single outside layer next to the window should have the coating on the exterior surface thereof while all the other layers should have their coatings facing into the room, as has been indicated at "S" in FIGS. 3 and 5. As far as thickness is concerned, the gain in insulating value through the use of a thicker layered curtain is relatively insignificant and it is more important to use more layers of thinner material provided, of course, that it has adequate strength, hangs properly, is capable of being wound on a storage roller and can be coated.

Looking next at FIGS. 1-4, it will be seen that the curtain includes an outer and an inner doubled layered air-entraining envelope that have been designated 20A and 20B, respectively together with a fifth single layer 20C lying inside the inner envelope 20B. Thus, in the inflated condition shown in FIG. 3, these five layers cooperate with one another to define a nested plurality of air bags, here a total of four essentially dead air pockets 40A, 40B, 40C and 40D between the layers 20A-C.

In the particular form shown, both the outer and inner air-entraining envelopes are formed from a single sheet of material folded over at the bottom, such folds 42A and 42B cradeling therein large and small diameter spreaders which have been denominated 44A and 44B, respectively. Hanging from the lower margin of single layer 20C is an elongate weight 44C which differs from spreaders 44A and 44B in that it performs no spreading function. All three members 44, however, act as both weights to maintain the curtain hanging properly and also guide members whose end portions are confined within the channels 32 of tracks 14 thus cooperating therewith to confine the open-sided pockets as well as guide same up and down the tracks. Spreaders 44A and 44B are shown to be tubular in shape primarily because this makes them lighter in weight. It should also, perhaps, be mentioned that the air-entraining envelopes 20A and 20B need not necessarily be fabricated from a single sheet of material folded over along the bottom because the curtain would function equally well by using two separate layers of material and sewing them together at the bottom or, alternatively, fastening them to the spreader rather than one another, provided that they are raised side-by-side and no attempt is made to roll them up. The folded configuration is obviously the simplest solution assuming the layers of each envelope can have the proper face thereof coated.

The diameter of spreader 44A is somewhat less than the width of channels 32; however, the length of all three elements 44 is preferably such as to extend well into the channels on both ends thereof.

Figure 2:
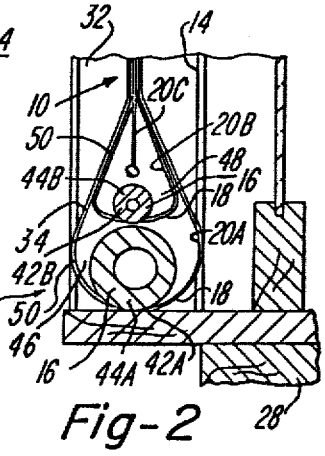
FIG. 2 is a view similar to FIG. 1 and to the same scale but different therefrom in that the curtain is shown lowered into operative position preparatory to being inflated.
Figure 3:
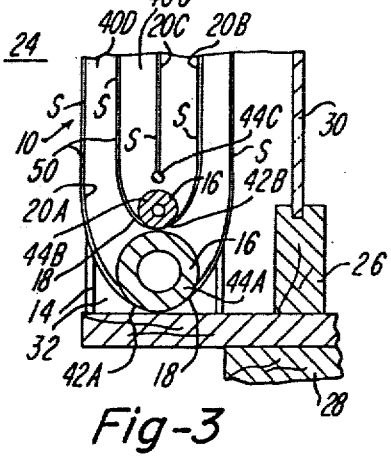
FIG. 3 is a view similar to both FIGS. 1 and 2 but different in that the curtain is shown fully inflated.

In FIGS. 1 and 2 it will be seen that spreaders 44A and 44B function to maintain a certain amount of residual air in the bottom of the pockets at all times regardless of whether the curtain is raised into its position shown in FIG. 1 or it is lowered into the operative position of FIG. 2 preparatory to being inflated. Communicating the interior of these permanent air pockets 46 and 48 (FIGS. 1, 2 and 4) that remain in the bottom of the curtain at all times and actually form a part of the previously identified pockets 40A-40D, are air intake openings 50. Air is expelled through these openings as well as through the open side margins by raising the curtain through the gap 38 between pinch rollers 22 when inflated as shown in FIG. 3. When the curtain is raised into the position of FIG. 1, the size of permanent pockets 46 and 48 is so limited by the pinch rollers that no appreciable quantity of air can enter the curtain. On the other hand, with the deflated curtain lowered into the operative position of FIG. 2, when the residual air confined in permanent pockets 46 and 48 is heated up by the radiant energy from either the sun shining through the window during the day time or, alternatively, by the room air at night during the winter. As it warms, it rises within the pockets thus spreading and self-inflating them by an inhalation process while, at the same time, drawing a fresh supply of air from the room (confined space 24) to supplement that which is already in said pocket. Actually, of course, only the outer envelope 40A gets its air from air space 24, inner envelope 40B getting its air from the outer one. In time, the pockets will be filled to capacity as shown in FIG. 3 at which point the side margins of the outer envelope will engage and seal against the opposed surfaces of the tracks as shown in FIG. 5 thus cooperating with the pinch rollers and storage roller to trap the air within the pockets thus filled. Of course, once the pockets are filled and the complete curtain inflated as shown in FIG. 3, it provides excellent insulating qualities.

In a test run with the curtain illustrated, two identical enclosures were constructed, each of which had an open wall area that could be covered by materials whose insulation values were to be compared with that of the instant inflatable curtain. The open areas were then glazed and identical heated masses placed within each enclosure. Thermocouples monitored the temperature of the masses, the enclosed air spaces and the air in the room where the test enclosures were situated. Such a set up simulated those conditions where a given enclosure containing window in an exterior wall also housed a medium within which to store solar gains.

The curtain used had five layers with the layer nearest the window having the reflective coating on the outside while the remaining four layers all had it on the inside, i.e. facing into the enclosure and away from the window. Approximately ¾ inches of dead air space existed between each layer making a total of some three inches of insulation since the thickness of each layer was negligible.

The other enclosure had a fiberglass batt 3½ inches thick placed in the same position relative to the window as the inflatable curtain. The exterior surface of this batt was covered with reflective silver colored foil.

The curtain of the instant invention showed significantly better energy retention for the warm mass than that provided by the reflective 3½ inch fiberglass batt. Conservatively, a so-called "R value" of 13 can be realized with the curtain forming the subject matter hereof, such an R value being quite close to the R value calculated for the curtain on the basis of the calculations prescribed for insulating materials in the ASHRAE Handbook of Fundamentals, 1972 Edition, particularly the tables for air spaces found therein with these values being adjusted in accordance with the emissivity values found elsewhere in the same work.

Figure 4:
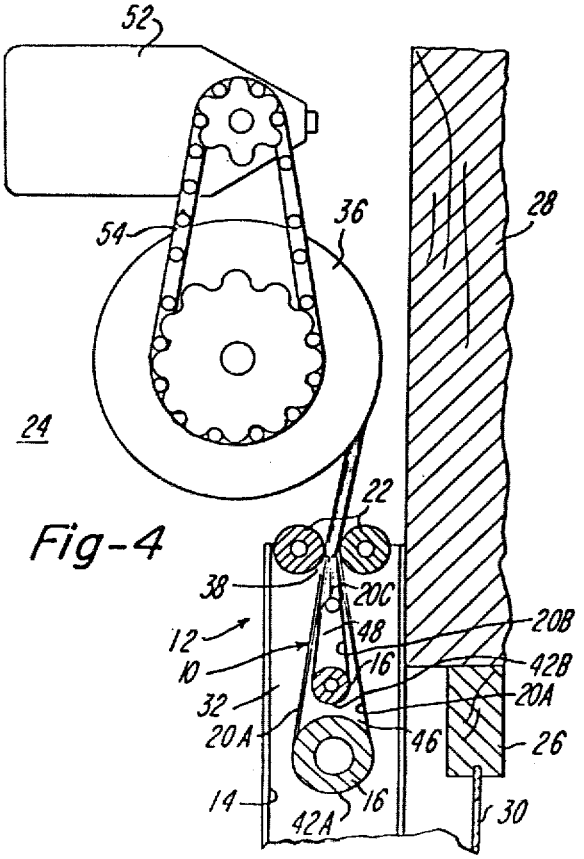
FIG. 4 is, once again a fragmentary vertical section to the same scale as the preceding figures but highlighting the storage roller at the top of the assembly upon which the curtain is stored and the drive mechanism for controlling the movement of said roller.
Figure 6:
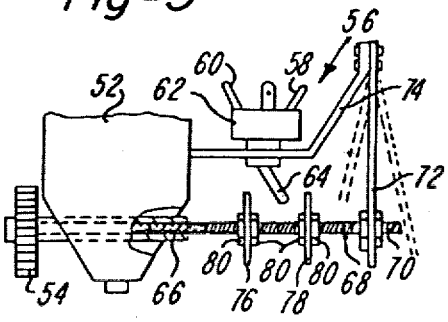

Looking briefly at FIGS. 4 and 6, it will be seen that the storage roller 36 can, if desired, be driven by a reversible gear motor 52 operatively connected to the latter by a suitable power transfer mechanism 54. The curtain is, of course, stored on roller 36 by winding it thereon "window shade fashion".

In the summer when the sun is shining, the curtain or air bag should, obviously, be lowered and inflated as shown in FIG. 3 to insulate the enclosure 24 and prevent the solar energy from heating it up. During the nighttime hours, on the other hand, the curtain or air bag should be raised into its inoperative or stored condition shown in FIG. 1 so that the heat within the room can escape through the glazed area into the cool night air outside. Thus the curtain may be raised or lowered on a prescheduled time table which may change with the seasons.

Finally, with specific reference to FIG. 6, the main features of an automatic control system for the curtain will be set forth in detail, said control system having been broadly designated by reference numeral 56. Temperature sensors 58 and 60 are mounted on the outside and inside of the curtain, respectively, and they are responsive to the temperature at these locations regardless of whether the curtain is raised or lowered. These sensors cooperate with one another and with motor control switch 62 to actuate motor 52 so as to either raise or lower the curtain. The particular circuitry required to do so is well within the skill of the ordinary artisan and it, for this reason, forms no part of the present invention. The functions performed by the control circuitry, on the other hand, are believed to be unique and, therefore, applicant considers them to be a part of his invention.

Sensors 58 and 60 can be set to respond to a particular temperature differential existing therebetween or, alternatively, they can be made to respond by energizing the motor to drive the curtain up or down whenever one senses a temperature different from the other. Either way, when these sensors coact to close switch 62, a circuit to the motor 52 is completed and it, in turn, raises or lowers the curtain depending upon its position at the time the sensors respond to a change in conditions. In other words, if the curtain is down in the summer time during the day in response to a pre-existing condition sensed by sensors 58 and 60, namely, that the temperature between the curtain and the window was hotter than that inside enclosure 24, then the next thing that would happen would be to raise the curtain whenever night fell or some other condition existed outside the enclosure when inside sensor 60 sensed a temperature greater than outside sensor 58. Conversely, with the curtain raised during a summer night to let the heat within closure 24 escape, inside sensor 60 presumably would be sensing a higher temperature than the outside one. As soon as the sun came up, however, sensor 58 would see the higher temperature of the two and coact with the inside one and switch 62 to lower the curtain.

During the winter in cold climates, the situation would be the opposite, namely, when the winter sun is out, the sensors would actuate switch 62 to raise the curtain instead of lowering it so that the heat from the sun could enter and heat the enclosure. At night, on the other hand, the curtain would be lowered to trap the heat inside the enclosure. Since this reversal in functions occurs but seldom, say a few times a year at most and oftentimes only twice, it is a simple matter to reverse the motor leads so that it runs in the opposite direction in response to a given sensor relation. Alternatively, a reversing circuit (not shown) can be provided that will accomplish the foregoing winter/summer function reversal by a simple flip of a function switch. Motor reversing circuits such as this are notoriously old in the art and no useful purpose would be served by setting same forth in detail since such a circuit per se forms no part of the present invention.

In conclusion, some means must, obviously, be provided for stopping the curtain once it has reached the limit of its excursion, up or down. Such a feature has been illustrated in FIG. 6; however, it is by no means the only way this stop function can be accomplished. Instead, it is intended as being merely representative of one such limit system which could easily be accomplished electronically, photoelectrically and, perhaps, in other ways.

The particular system shown is an electromechanical one wherein a conventional double-throw toggle switch is mechanically actuated to shut off motor 52 whenever curtain 10 reaches the preselected limit of its excursion, up or down. Motor shaft 66 is hollow and internally threaded to receive jack screw 68. A flat 70 is provided on the jack screw and a spring arm 72 with a flat sided opening therein (not shown) receives the end of said shaft and prevents same from rotating although it permits it to move to and fro axially. Spring arm 72 is secured to a suitable bracket 74 which, in the particular form shown, also mounted the toggle switch 64 along with other elements of the automatic curtain control assembly.

A pair of actuating members 76 and 78 are mounted in axially-spaced relation on jack screw 68 and are maintained in adjusted position therealong by nuts 80.

As viewed in FIG. 6, the next response of the motor will be such as to turn its shaft 66 in a direction to screw the jack screw 68 therein thus moving actuating member 78 toward toggle switch 64 which it will ultimately engage and flip to its alternate position to the left of where it is shown. In so doing, this switch will shut off the motor thus stopping the curtain at one of its two extreme positions. By the same token, the next actuation of motor 52 will be in a direction to extend the jack screw to a point where actuator 76 will function to return the toggle switch to the position it formerly occupied. Spring arm 72 can bend to the extent necessary to accommodate the jack screw excursion aforementioned.

What is claimed is:

1. In combination in an air bag curtain which inhales or exhales responsive to changes in ambient temperatures, thereby providing a self-inflating or deflating insulating assembly: a first generally rectangular sheet of flexible material folded in half and hung from the margins thereof opposite said fold so as to provide a double-paneled curtain with vertically-disposed side margins, said curtain including openings therein adjacent the fold for the intake and expulsion of air; means engaging the side margins of said curtain cooperating therewith to seal the latter and define a first closed-top air bag which inhales responsive to a heating of air within said bag with a consequent increase in air bag volume; means including a horizontal deflation slot disposed above said first air bag effective to expel air through the openings therein when said curtain is drawn upwardly through said slot; spreader means cradled within the fold in the curtain effective to define a pocket holding residual air which expands and therefore fills said first bag when the air therein is heated; and storage means located above the slotted means suspending the curtain therein for movement therethrough between raised and lowered positions.

2. The combination as set forth in claim 1 wherein a second rectangular sheet is folded and hung inside the first air bag, said second sheet having openings therein for the intake and expulsion of air, and said second sheet cooperating with the side margin engaging means and the slotted means to define a second air bag inside the first.

3. The combination as set forth in claim 1 wherein the means engaging the side margins of the curtain comprises a pair of upright tracks with inwardly-opening channels arranged in opposed transversely-spaced parallel relation.

4. The combination as set forth in claim 1 wherein the horizontal deflation slot means comprises a pair of pinch rollers arranged in spaced substantially parallel relation.

5. The combination as set forth in claim 1 wherein the curtain storage means includes a roller mounted for rotation about a horizontal axis extending in the direction of the length of the curtain and a reversible drive means operatively connected to said roller for rotating same in either direction.

6. The combination as set forth in claim 1 wherein the exterior surfaces of both panels of the first sheet are covered with a reflective coating.

7. The combination as set forth in claim 2 wherein one pair of corresponding surfaces of the second sheet are covered with a reflective coating.

8. The combination as set forth in claim 2 wherein a third rectangular sheet is hung inside the second air bag.

9. The combination as set forth in claim 2 wherein a second spreader means is cradled within the fold at the bottom of the second sheet cooperating therewith to define a permanent air pocket thereabove within the bottom of the second air bag.

10. The combination as set forth in claim 3 wherein the spreader means extends the full width of the curtain and has its ends confined within the channels of the tracks, said tracks and spreader cooperating to guide the curtain as it is raised and lowered.

11. The combination as set forth in claim 5 which includes automatic control means operatively associated with the reversible drive means and adapted to raise and lower the curtain in response to a predetermined difference in temperature sensed on opposite sides thereof, said control means including a two position reversing switch connected to the reversible drive means operative in one position to energize the latter in a direction to raise the curtain and in its second position in a direction to lower same, temperature-responsive switch actuating means having a pair of temperature sensitive probes positionable on opposite sides of the curtain connected to said reversing switch and operative to shift same in one direction when said probes sense a condition in which one side of the curtain is hotter than the other and to shift said switch in the opposite direction when said one side is the cooler of the two, and means comprising limit switches connected to the drive means and operative to deenergize same when the curtain has reached a predetermined point in its excursion up or down.

12. The combination as set forth in claim 8 wherein the exterior surfaces of the first sheet are covered with a reflective coating and corresponding surfaces of the second and third sheets are covered with a reflective coating while the reverse sides of all five of said coated surfaces are left uncoated.

13. The combination as set forth in claim 8 wherein the bottom edge of the third sheet is weighted.

14. The combination as set forth in claim 9 wherein the second spreader means is smaller than the first so that the permanent air pocket in the bottom of the first air bag partially envelopes the second air bag.

15. The combination as set forth in claim 11 which includes a two position mode reversal switch connected to reverse the function performed by the reversible drive means in response to a given position of the reversing switch.

16. A dynamic insulating device primarily for use against an interior side of an outside wall, said insulating device being free of stiffening elements and comprising a thin, flexible and closed air bag shaped and proportioned to cover an insulated portion of said wall, said closed air bag including an air-entrapping space with at least one opening from said space to ambient air, said opening being near the bottom of said air bag, means for hanging said air bag over said insulated portion of said wall, the size of said opening being shaped and proportioned relative to the size of said air bag so that any air entrapped therein causes the volume of said air bag to change as a function of changes in the ambient temperature in the vicinity of the interior side of said wall, the warmer ambient air causing the volume of said air bag to increase whereby fresh air is drawn through said opening in an inhalation process and cooler ambient air causing the volume of said air bag to decrease whereby entrapped air leaves said air bag through said openings in an exhalation process.

17. The device of claim 16 wherein the insulated portion of said wall includes at least one window area.

18. The device of claim 17 and means for raising and lowering said air bag, and means associated with said air bag for reducing the volume of said air entrapping space and thereby forcing air out of said air bag.

19. The device of claim 18 wherein said volume-reducing means comprises a pair of spaced parallel pinch rollers positioned above and on opposite sides of said air bag to form a deflation groove through which said air bag is drawn as said air bag is raised and lowered.

20. The device of claim 19 and means for sensing the temperature on opposite sides of said air bag, and means for raising and lowering the air bag through said deflation groove responsive to the differential of temperatures sensed on said opposite sides of said air bag.

21. A process for dynamically insulating a wall area, said process comprising the steps of:

(a) hanging an air bag over an insulated wall area, said air bag defining a dead air space having at least air intake opening in the bottom thereof;

(b) enabling said air bag to self-inflate through said intake opening responsive to increased temperature adjacent said air bag; and (c) deflating said air bag by squeezing the air out said intake opening.

22. The process of claim 21 and the added step of coating one side of at least one of the panels with a reflective coating.

23. The process of claim 22 and the added step of providing a plurality of nested air bags for defining a plurality of dead air spaces.

24. The process of claim 23 and the added step of enabling said bag to inflate and of deflating said bag to a prescheduled time table.

25. The process of claim 24 and the added step of changing said prescheduled time table during different parts of the year.

* * * * *